United States Patent [19]

Byrnes

[11] Patent Number: 4,884,529

[45] Date of Patent: Dec. 5, 1989

[54] STEAM GENERATOR

[75] Inventor: Thomas S. Byrnes, Ontario, Canada

[73] Assignee: Blower Engineering, Inc., Concord, Canada

[21] Appl. No.: 318,446

[22] Filed: Feb. 28, 1989

Related U.S. Application Data

[63] Continuation-in-part of Ser. No. 120,011, Nov. 12, 1987, abandoned.

[51] Int. Cl.[4] ..... F22B 9/02

[52] U.S. Cl. ..... 122/115; 60/39.55

[58] Field of Search ..... 60/39.55, 39.05, 39.826; 126/350 B; 122/114, 115, 45

[56] References Cited

U.S. PATENT DOCUMENTS

| | | | |
|---|---|---|---|
| 1,160,145 | 11/1915 | Davis | 60/39.55 |
| 2,485,427 | 10/1949 | Arnold | 60/39.55 |
| 2,916,877 | 12/1959 | Walter | 60/39.55 |
| 4,211,071 | 7/1980 | Wyatt . | |
| 4,288,978 | 9/1981 | Wyatt | 60/39.55 |
| 4,337,619 | 7/1982 | Wyatt . | |
| 4,418,651 | 12/1983 | Wyatt . | |
| 4,441,460 | 4/1984 | Wyatt . | |
| 4,442,898 | 4/1984 | Wyatt . | |

FOREIGN PATENT DOCUMENTS

| | | | |
|---|---|---|---|
| 127015 | 5/1919 | United Kingdom | 60/39.55 |

*Primary Examiner*—Donald E. Stout
*Attorney, Agent, or Firm*—Ridout & Maybee

[57] ABSTRACT

A compact instant steam generator is provided for on site use where various qualities of steam may be required. A water jacket cooled combustion chamber having a burner at one end and a water spray nozzle at the other end is used. In operation, a water spray is directed countercurrently to the burner exhaust gases whereby instant vaporization of the water occurs due to the extreme turbulence and thorough mixing of the opposing streams. The water spray is located remote from the burner flame so that flame quenching by the water does not occur. The device of the invention is capable of generating steam while coproducing a very low level of carbon monoxide.

8 Claims, 3 Drawing Sheets

STEAM GENERATOR

This application is a continuation-in-part of Ser. No. 07/120,011 filed Nov. 12, 1987, now abandoned.

The present invention is an instant steam generator. The invention provides a compact unit having no boiler which can be used on site to generate various qualities of steam for a variety of applications. For example, the invention has particular application for curing prestressed and precast concrete and generally for the standard curing of concrete products such as blocks or pipes. During curing of concrete products, it is desirable to maintain a uniform temperature throughout the concrete and to maintain the surface of the concrete moist. The concrete curing process generates heat, which tends to warm up the inside of concrete products By stacking the concrete blocks or other items in a room and then subjecting them to steam, one simultaneously achieves the two objects of maintaining the blocks at a uniform curing temperature and maintaining them moist. By curing the blocks in this fashion, one can obtain, for example, a 28 day cured concrete strength in 24 hours.

A desirable feature for an instant steam generator is that it has a low carbon monoxide output. A low carbon monoxide output is essential where the steam generator is operated in an enclosed facility, for example, in a concrete products plant or in a mine, in order to meet typical government regulations for worker exposure to carbon monoxide.

The invention employs a unique combustion chamber and water vaporization combination whereby the combustion chamber is cooled by a surrounding jacket of circulating water, and the outflow of water from the jacket is used as the source of water to be vaporized by combustion gases from a burner located at one end of the chamber. The present arrangement differs from that previously known, for example as described in U.S. Pat. No. 4,211,071 Wyatt, July 8, 1980, by introducing a spray of water countercurrently to the stream of combustion gases exiting the combustion chamber. This arrangement creates a great deal of turbulence in the area surrounding the water spray thus ensuring instant and thorough vaporization of the spray by the combustion gases. In prior devices, e.g. Wyatt, water flows through a jacket around the combustion chamber and is then discharged through an annulus around a flame-enclosing shield so that the water flows with the hot gases concurrently through the combustion chamber. In practice, it has been found that this concurrent flow of water about the flame leads to flame instability and quenching which causes the formation of unacceptably high levels of carbon monoxide in a poorly ventilated work area about the generator. By introducing the water spray in a region remote from the burner flame, the problem of flame quenching is eliminated. The use of the water cooled jacket for the chamber obviates the need to use refractory material to line the chamber and provides the added benefit of preheating the water for vaporization.

In accordance with the present invention, there is provided a steam generator, comprising a water jacketed combustion chamber formed by first and second ends being connected by a sidewall. The water jacket has an inlet and an outlet for the circulation of water through the jacket. A burner is positioned in the first end of the combustion chamber. Means are provided for delivering pressurized air and fuel to the burner so that the burner may produce a flame extending toward the second end of the combustion chamber. A water spray nozzle is positioned at the second end of the combustion chamber remote from the burner flame, said nozzle being connected to the outlet of the jacket and being adapted to spray water countercurrently into a stream of hot gases from the burner flame thereby creating steam without quenching the flame. A discharge conduit, providing an outlet means in the second end of the combustion chamber, is connected to the second end of the combustion chamber for conveying the steam so generated. Thus, the present invention employs a unique arrangement in which the water is sprayed countercurrently to the flow of hot gases, and the water spray nozzle can be pointed directly at the burner. This arrangement is contrary to conventional teachings which specify that the water should be sprayed away from the flame to avoid flame quenching.

In fact, it has been found that by spraying water directly at the combustion gases coming from the burner flame, extremely efficient steam generation can be achieved. It is believed that this arrangement promotes turbulence between the water spray and the hot exhaust gases, thereby effecting an instant heat transfer to the water spray creating steam. It has been found, surprisingly, that steam generated in accordance with the invention does not result in flame quenching even when producing steam at pressures much higher than those achievable by prior devices. This result is obtained by introducing the water spray into a region of the device which is remote from the burner flame so that the water spray does not interfere with the combustion process at the burner. Since fuel combustion is not affected by the water spray in the present invention, a device equipped with an efficient burner may produce a sufficiently low level of carbon monoxide to be suitable for use in enclosed work areas.

It should be appreciated that although the drawings show an arrangement suitable for a natural gas or propane burner, an oil burner can also be used with the invention by making appropriate changes to the air and fuel supply means known to those skilled in the art.

Figure 1:
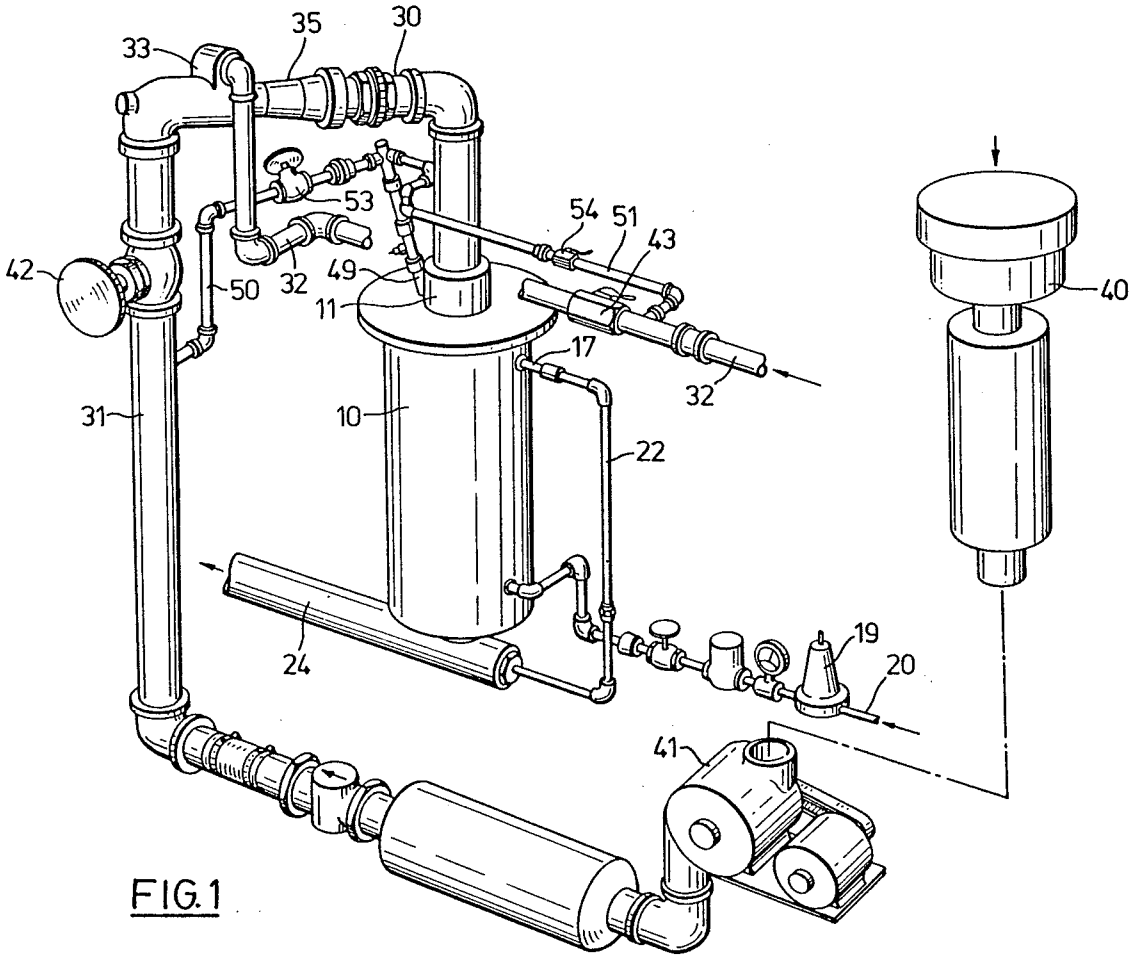
FIG. 1 is a perspective view of the generator partially exploded and partially broken away for clarity.
Figure 2:
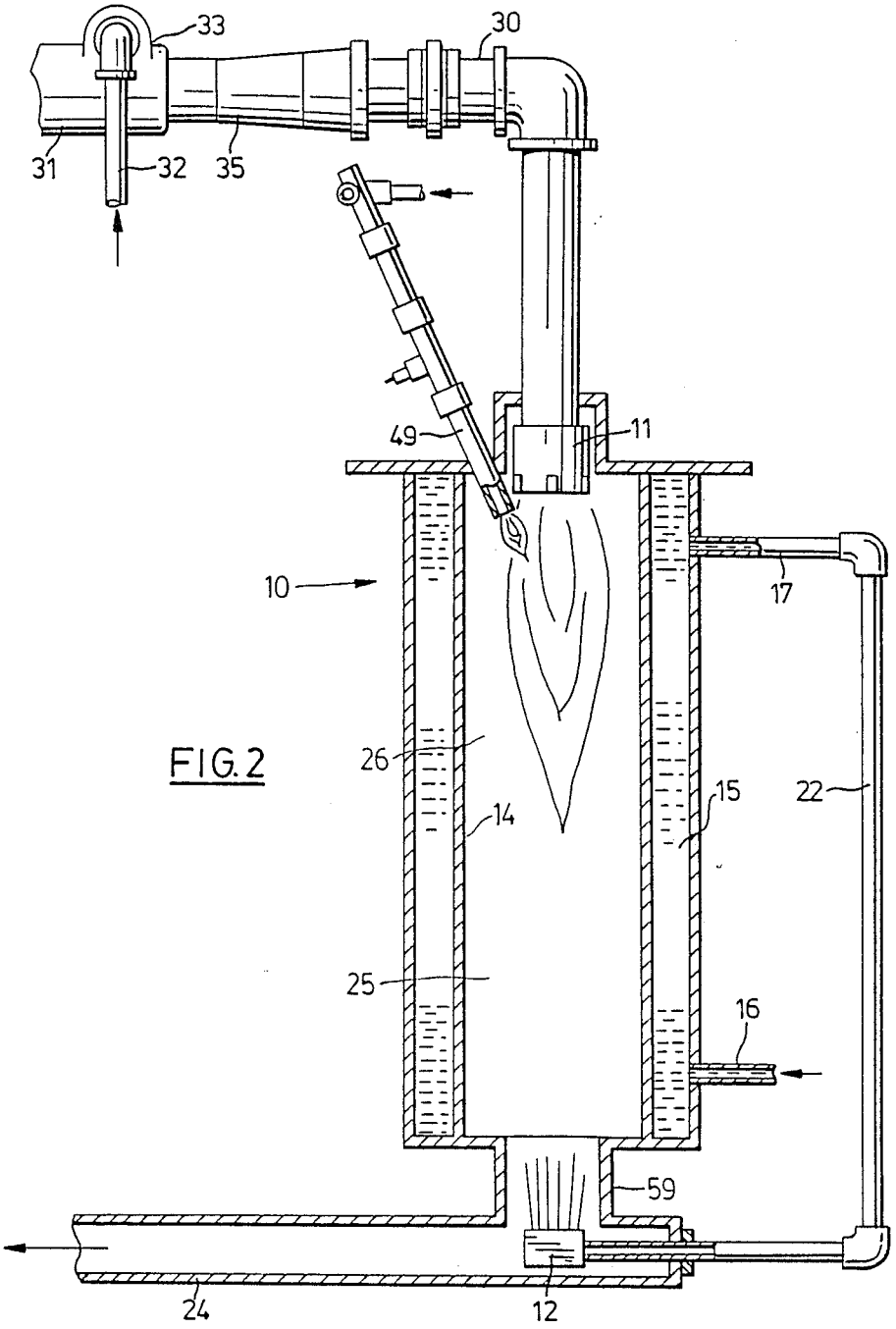
FIG. 2 is a vertical sectional view of the combustion chamber and associated components.

The steam generator of the present invention comprises a combustion chamber 10 having a burner 11 at one end and a water spray nozzle 12 at the other end. The chamber 10 has a sidewall 14 provided with a water jacket 15 (FIG. 2) having a jacket inlet 16 near the lower end of the chamber !0 and a jacket outlet 17 near the upper or burner end of the chamber 10. Water is circulated through the jacket 15 at a rate of circulation governed by water pressure controls 19 which are readily available and which are inserted into the water inlet line 20. Water exiting the jacket 15 proceeds through the jacket outlet 17 and a pipe 22 to the water spray nozzle 12 which is in turn located within a steam outlet line or discharge conduit 24 extending from the lower end of the chamber 10. The combustion chamber 10 is sized to enable complete combustion of the fuel by the flame of the burner 11 within the confines of the chamber 10. Indeed, as shown in FIG. 2, it is preferred to have a zone 25 in the lower portion of the combustion chamber 10 for the hot exhaust gases of combustion with fuel combustion occurring to the fullest extent allowed by the mechanics of the burner 11 in a zone 26 in the upper portion of the chamber 10 about the flame.

The burner 11 is an oil burner or preferably a burner of the type which burns a pressurized gaseous fuel mixture such as air and natural gas or propane. Accordingly, the burner 11 is provided with an inlet conduit 30 comprising a larger diameter inlet air pipe 31 for pressurized air, into which is joined a fuel pipe 32 of a lesser diameter. The junction point 33 of the pipes 31 and 32 is just upstream of a venturi 35. The gaseous fuel mixture is thoroughly mixed by flowing through the venturi 35 thereby ensuring even combustion at the burner head 11 and affording good control of the heat output therefrom.

The air supplied to the inlet air pipe 31 is pressurized in a conventional manner by drawing air in through a filter 40 and passing it through a blower 41 or other well known compression means. Pressure in the inlet air pipe 31 may be regulated by use of an appropriate air pressure valve 42, and pressure in the fuel pipe 32 may be controlled by a conventional fuel valve 43. By adjustment of the valves 42 and 43, the pressure and composition of the fuel mixture can be varied as desired.

Ignition of the burner 11 may conveniently be accomplished by use of a pilot 49 located adjacent the head of the burner 11. The pilot 49 may receive a fuel mixture from feeder lines 50 and 51 taken from the main fuel pipe 32 and the inlet air pipe 31. The feeder lines 50 and 51 tap the main pipes 31 and 32 at points upstream of the respective valves 42 and 43. The feeder lines 50 and 51 are also provided with valves 53 and 54 so that the desired combustion gas mixture and pressure can be provided to the pilot 49.

It will be apparent to the person skilled in this art that any of a number of different kinds of burners would be suitable for use in the present invention. Since the steam generated by the present device contains the exhaust from the burner 11, it may be particularly desirable in certain applications to choose a burner 11 which produces a low level of carbon monoxide. The low carbon monoxide level of the burner 11 will be retained during the steam generating process using the present device, because there is no flame quenching produced by the countercurrent spray of water from the nozzle 12. Likewise, the foregoing description of the fuel and air supply means is illustrative and may be varied with the type of burner used. It will also be apparent to those skilled in this art that central control means may be employed to coordinate the flows and relative pressures of the fuel, air and water streams for the overall system.

In operation, steam is generated by the mixture of the water spray from the water spray nozzle 12 with the hot combustion gases produced by the burner 11 at the lower end of the combustion chamber 10. By causing the spray from the water spray nozzle 12 to be directed countercurrently to the exhaust gases from the burner 11, instant vaporization of the water occurs due to the extreme turbulence and thorough mixing of the opposing streams. Turbulence and mixing of opposing streams may be modified by the insertion of baffles in the combustion chamber 10 and in the steam outlet line 24. The quality of the steam exiting through the steam outlet line 24 may be determined by adjusting the output of the burner 11 and the output of the water spray nozzle 12. The relative opposing pressures from the burner 11 and the spray nozzle 12 must be adjusted to enable steam to be generated in the manner described, that is, by vaporization of the water contacting the hot exhaust gases from the burner 11. The generation of relatively low pressure steam, i.e. 5–20 psi, is accomplished using the invention wherein the water vaporization occurs virtually entirely within the outlet neck 59 located between the lower end of the combustion chamber 11 and the steam outlet line 24.

Figure 3:
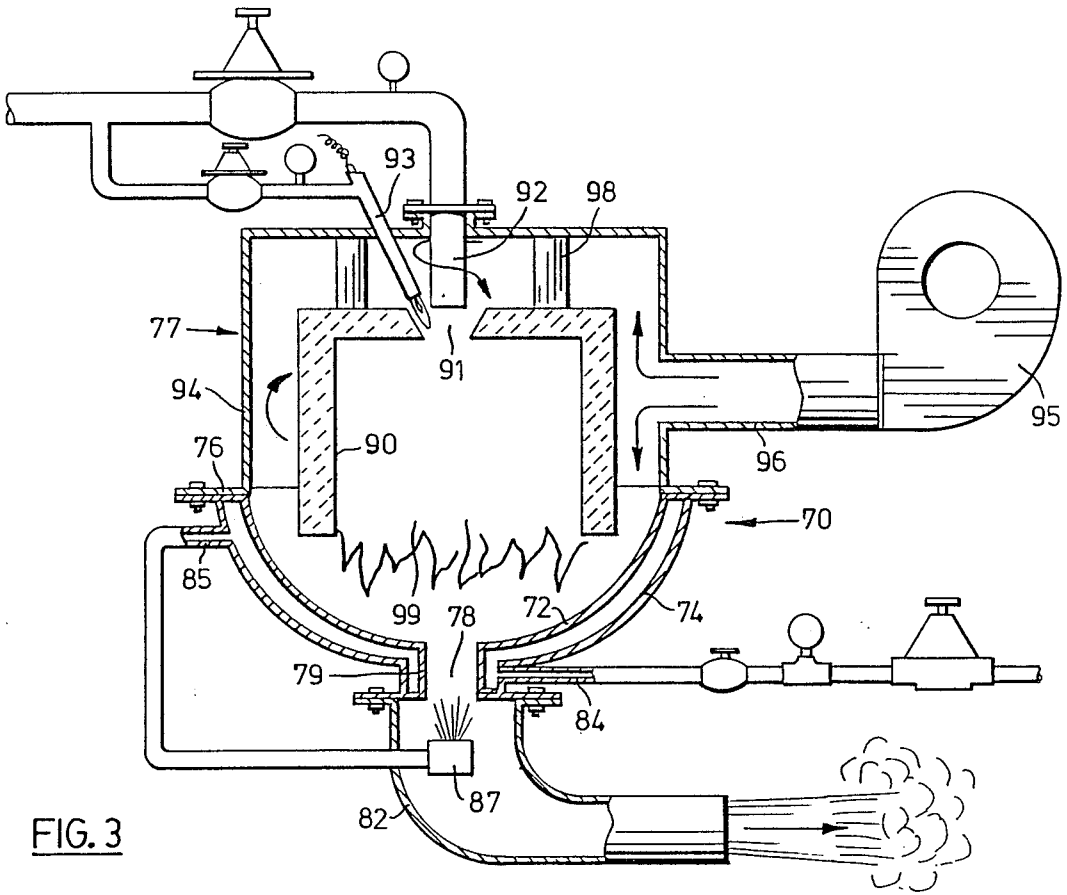
FIG. 3 is a cross sectional view of a second preferred embodiment for the combustion chamber.

A second preferred embodiment of the invention is shown in FIG. 3, wherein a combustion chamber 70 has a sidewall 72 equipped with a water jacket 74. The combustion chamber 70 has a first or top end 76 which receives a burner 77, and the combustion chamber 70 has a second or bottom end 78 which is provided with an outlet means 79 to which is attached a conduit 82 for conveying steam generated by operation of the invention. As shown in FIG. 3, the preferred shape of the water jacket 74 and sidewall 72 is hemispherical with the outlet means 79 being cylindrical and centered about the bottom of the hemispherical chamber 70. Due to the extreme heat developed by the burner 77, it is preferable to extend the water jacket 74 about the outlet 79.

As with the device previously described, the water jacket 74 has an inlet line 84 and an outlet line 85 for circulating water through the jacket 74 to cool the sidewall 72 and outlet 79. The water exiting through the outlet line 85 proceeds to a spray nozzle 87 preferably located in the conduit 82 at the exit opening of the outlet 79. The spray nozzle 87 is positioned remotely from the flame produced by the burner 77, and the nozzle 87 is oriented to spray water countercurrently into the stream of hot gases produced by the burner 77. As with the embodiment first described, the location of the spray nozzle 87 at the second end 78 of the combustion chamber 70 must be sufficiently remote from the burner flame so that quenching of the flame is avoided.

The burner 77 is a commercially available unit designed to provide complete fuel combustion. The burner 77 has a refractory lined inner casing 90 having a frustoconical opening 91 in its top surface at which is positioned the burner head 92 and pilot 93. An outer casing 94 is spaced from the inner casing 90 to define a space about the inner casing 90 for circulation of air introduced into the space by a blower 95. The blower 95 is connected to the burner 77 by a conduit 96. Volute vanes 98 are spaced about the burner head 92 between the inner casing 90 and outer casing 94 to provide a swirling motion for the air about the burner head 92. Fuel, such as natural gas, is delivered to the burner head 92 where it is mixed with the swirling air as the fuel exits the burner head 92, and the mixture is ignited by the pilot 93. The swirling gases form a toroidal flow pattern for the flame within the inner casing 90. The motion of the burning gases provides a sufficiently long residence time in a combustion zone 99 within the inner casing 90 so that complete fuel combustion is achieved. Hot gases of combustion proceed from the combustion zone 99 to the second end 78 of the combustion chamber 70 where the gases are contacted by a countercurrent flow of water from the spray nozzle 87. The water spray is instantly vaporized to steam at the second end 78 and is discharged through the conduit 82 along with the exhaust gases of the burner 77.

Experience with the particular embodiment shown in FIG. 3 has shown that little if any water spray enters the combustion chamber 70, and the resulting steam at pressures of from about 5 psi to about 20 psi contains less than about 3 ppm carbon monoxide, and typically 1 ppm or less, so that the steam generated by the invention may be used in enclosed workplaces without exposing workers to dangerous levels of carbon monoxide.

The principles of the invention as described may be utilized to generate steam of much higher pressure than heretofore was thought possible using a direct fired generating device. Thus, while the foregoing has disclosed preferred embodiments, it is not intended that this disclosure be construed as restricting the scope of the invention which is defined in the following claims.

I claim:

1. A steam generator, comprising:

a combustion chamber having a water jacketed sidewall defining first and second ends of the chamber, an inlet and an outlet means for the circulation of water through the jacket;

a burner positioned at the first end of the combustion chamber;

means for delivering pressurized air and fuel to the burner, so that the burner may produce a flame extending toward the second end of the combustion chamber;

a water spray nozzle positioned at the second end of the combustion chamber remote from the burner flame, said nozzle being connected to the outlet means of the jacket and being adapted to spray water countercurrently into a stream of hot gases from the burner flame thereby creating steam without quenching the flame; and an outlet means at the second end of the combustion chamber being connected to a conduit for conveying the steam so generated.

2. A generator as claimed in claim further comprising a pilot positioned at the first end of the combustion chamber to provide a pilot flame for the burner.

3. A generator as claimed in claim 1, wherein the means for delivering the air and fuel to the burner comprises a blower for pressurizing the ambient air, an air supply pipe connected between the blower and the burner, and a fuel supply pipe connected to the air supply pipe.

4. A generator as claimed in claim 3, which includes a pilot positioned at the first end of the combustion chamber to provide a pilot flame for the burner, and air and fuel feeder lines connecting the air supply pipe and the fuel supply pipe to the pilot.

5. A generator as claimed in claim 4, wherein each of the air and fuel supply pipes and each of the air and fuel feeder lines includes a control valve, with the control valves of the air and fuel pipes being located downstream from the respective connections to the compressed air and fuel feeder lines.

6. A generator as claimed in claim 1, wherein the water inlet means of the water jacket is located adjacent the second end of the combustion chamber and the water outlet means of the water jacket is located adjacent the first end of the combustion chamber whereby water flows through the water jacket countercurrently to the flow of hot gases in the combustion chamber.

7. A generator as claimed in claim 1, wherein the water spray nozzle is positioned in the conduit connected to the outlet means at the second end of the combustion chamber.

8. A generator as claimed in claim 1, wherein the spray nozzle is positioned in the conduit connected to the outlet means at the second end of the combustion chamber and is configured such that, in use, water spray from the spray nozzle countercurrently contacts the hot gases from the burner so that substantially all water vaporization occurs in the outlet means and conduit.

* * * * *